US005215849A

United States Patent [19]

Makuta et al.

[11] Patent Number: 5,215,849

[45] Date of Patent: Jun. 1, 1993

[54] NON-MAGNETIC ONE-COMPONENT DEVELOPER

[75] Inventors: Yoshihiro Makuta; Mitsuo Ueno, both of Kanagawa; Minoru Isobe, Tokyo; Hiroshi Kikuchi, Tokyo; Katsuyuki Ito, Tokyo, all of Japan

[73] Assignees: Nippon Zeon Co., Ltd; OKI Electric Industry Co., Ltd., both of Tokyo, Japan

[21] Appl. No.: 640,498

[22] Filed: Jan. 14, 1991

[30] Foreign Application Priority Data

Jan. 16, 1990 [JP] Japan ..... 2-4614

[51] Int. Cl.[5] ..... G03G 9/08

[52] U.S. Cl. ..... 430/110; 430/109; 430/114

[58] Field of Search ..... 430/110, 109, 114

[56] References Cited

U.S. PATENT DOCUMENTS

| | | | |
|---|---|---|---|
| 2,895,847 | 7/1959 | Mayo . | |
| 3,152,012 | 10/1964 | Schaffert . | |
| 3,909,258 | 9/1975 | Kotz . | |
| 4,121,931 | 10/1978 | Nelson . | |
| 4,660,960 | 4/1987 | Fukunaga et al. | 355/3 |
| 4,702,986 | 10/1987 | Imai et al. | 430/125 |
| 4,868,084 | 9/1989 | Uchide et al. | 430/110 |
| 5,066,558 | 11/1991 | Hikake et al. | 430/110 |

FOREIGN PATENT DOCUMENTS

| | | |
|---|---|---|
| 59-231550 | 12/1984 | Japan . |
| 59-231552 | 12/1984 | Japan . |
| 63-73271 | 9/1986 | Japan . |
| 62-52564 | 3/1987 | Japan . |
| 1-138568 | 5/1989 | Japan . |

*Primary Examiner*—Marion E. McCamish
*Assistant Examiner*—S. Rosasco
*Attorney, Agent, or Firm*—Lowe, Price, LeBlanc & Becker

[57] ABSTRACT

A non-magnetic one-component developer suitable for use in a contact or non-contact development system. The developer comprises 100 parts by weight of colored fine particles, which comprises a binder resin and a colorant, and 0.3–10 parts by weight of at least one fine inorganic powder selected from (i) a fine inorganic powder (I) obtained by subjecting a fine inorganic powder having an average particle size of 0.1–10 μm and a heating loss (under drying conditions of 150° C. and 1 hour) of at most 1 wt.% to a hydrophobicity-imparting treatment with a silicone oil and (ii) a fine inorganic powder (II) obtained by subjecting a fine inorganic powder having an average particle size of 0.1–10 μm to a two-step hydrophobicity-imparting treatment with at least one compound selected from silane coupling agents and silazane compounds and then further with a silicone oil.

3 Claims, 1 Drawing Sheet

NON-MAGNETIC ONE-COMPONENT DEVELOPER

FIELD OF THE INVENTION

This invention relates to a developer, and more specifically to a non-magnetic one-component developer suitable for use in developing electrostatic latent images formed on a photosensitive or dielectric member by an electrophotographic apparatus or electrostatic recording apparatus.

BACKGROUND OF THE INVENTION

A mixture composed of colored fine particles, which comprises at least a binder resin and a colorant, and more fine colloidal silica or the like, which is added as a flowability-imparting agent independently of the colored fine particles, will hereinafter be called a "toner". Two-component developers composed of a toner and a carrier are used widely owing to good quality in images developed thereby.

On the contrary, the two-component developers however involve the following common defects. Namely, (1) a toner is triboelectrically charged by mutual friction between the toner and a carrier. However, when a two-component developer is used for a long period of time, the surface of the carrier is contaminated with the toner, so that it is impossible to apply sufficient triboelectric charge to the toner;

(2) the toner and carrier must be controlled at a mixing ratio within a fixed range. However, when the developer is used for a long period of time, the mixing ratio is changed outside the fixed range; and (3) the surface of a photosensitive member is mechanically damaged by iron powder the surface of which is oxidized or glass beads, which are both generally used as carriers.

Therefore, in recent years, various developing processes making use of a magnetic one-component developer, which is free of any carrier and contains magnetic powder in a toner, have been proposed (for example, U.S. Pat. Nos. 3,909,258 and 4,121,931).

However, these known processes are also accompanied by the following defects. Namely, (1) since the magnetic one-component developer contains a large amount of magnetic powder which is low in electrical resistance, it is difficult to electrostatically transfer an image developed on an electrostatic latent image to a support material such as plain paper. In particular, sufficient performance in transferring cannot be attained under a high-humidity atmosphere;

(2) it is difficult to produce color developers because the magnetic one-component developer contains a large amount of the magnetic powder of a black color; and (3) since the magnetic one-component developer contains a large amount of the magnetic powder, its fixing capability is lowered as compared to the two-component developer. As a result, the temperature and pressure of a fixing device must be raised, resulting in increased running cost.

In more recent years, the spotlight of attention has been focused on developing processes making use of a one-component developer free of any magnetic powder and high in electrical resistance. As their developing processes, may be mentioned those based on the touch-down or impression development which is described in, for example, U.S. Pat. No. 2,895,847 or 3,152,012, or Japanese Patent Publication No. 9475/1966, 2877/1970 or 3624/1979. These processes use, as a non-magnetic one-component developer, a toner obtained by taking a carrier out of a conventional two-component developer.

Even in this case, it is however impossible to avoid the occurrence of various problems incidental to the non-magnetic one-component developer as described below.

The first problem is an adhering phenomenon of the developer to a photosensitive member and/or the like. In the conventional two-component developers, a large amount of a carrier such as iron powder or glass beads is mixed in addition to a toner. Therefore, if the toner temporally adheres onto a development roll, development blade and/or photosensitive member, this offers no problem because they are polished by the carrier.

However, since only colloidal silica having a particle size as small as 10–20 mμ is independently added as a flowability-imparting agent in the toner as the conventional non-magnetic one-component developer, this developer has little polishing effect. Accordingly, when the developer is used for a long period of time, the toner often adheres onto the development roll, development blade and/or photosensitive member, thereby forming a film of the developer.

The formation of such a developer film makes it impossible for the developer to be charged to come into full contact with the development roll or development blade, resulting in insufficient charge of the developer and hence deteriorated quality of the developed image. In addition, the adhesion of the developer to the photosensitive member has offered a problem that it appears as black scumming.

In more recent years, it has therefore been proposed to independently add a fine inorganic powder having a particle size as great as 0.1–10 μm (or a specific surface area as large as 0.2–30 $m^2/g$), thereby enhancing the polishing effect (for example, Japanese Patent Application Laid-Open Nos. 32060/1985, 136752/1985, 183664/1986 and 88554/1989).

However, sufficient flowability cannot be imparted by only the fine powders being used in Japanese Patent Application Laid-Open Nos. 136752/1985 and 183664/1986 and it is hence indispensable to use the conventional flowability-imparting agent such as colloidal silica in combination as described in Japanese Patent Application Laid-Open Nos. 32060/1985 and 88554/1989, resulting in the following unavoidable problem.

The second problem is that such developers cannot be used in a recycling system.

Namely, an image formed by a developer after development of an electrostatic latent image on the surface of a photosensitive member is transferred to a support material such as paper. The whole developer used in the development on the photosensitive member is not completely transferred and 20–40 wt.% of the developer generally remains on the photosensitive member. In a copying machine or printer making use of the conventional non-magnetic one-component developer, the untransferred developer remaining on the photosensitive member has been scraped off by a cleaning blade or the like and collected together to thrown away into a waste developer container.

That reason is that when the developer is used in a recycling system, it passes repeatedly through the imageforming process and hence incurs mechanical external force, whereby the flowability-imparting agent (colloidal silica) to exist on the surfaces of the developer particles is embedded in the developer particles and/or caused to fall off.

As a result, its flowability is excellent in the beginning, but is deteriorated as it is used for a long period of time in the recycling system, so that it is impossible to apply the developer onto a development roll to a constant thickness, resulting in uneven image quality. In addition, its charge level is changed and fog is also produced.

Moreover, when the untransferred developer on the photosensitive member is fed by a screw or the like to use it in the recycling system, the developer is compressed to get clogged, adheres to various parts and/or agglomerates. It has therefore been difficult to use it in long-term continuous operation.

The recycle for reuse of a developer is economical in itself because the 20–40 wt.% portion of the developer, which has been scrapped to date, can be reused and no waste developer container is required, and is also desirable for making apparatus such as copying machines and printers small in size.

OBJECTS AND SUMMARY OF THE INVENTION

It is an object of this invention to provide a non-magnetic one-component developer, which can overcome the above-mentioned problems involved in the prior art, has sufficient charging characteristic, flowability and environmental stability as a developer suitable for use in a contact or non-contact development system, and is high in image quality level such that high image density can be obtained and the production of fog occurs little.

Another object of this invention is to provide a non-magnetic one-component developer free from formation of a film caused by adhesion of the developer to a development roll, development blade and/or photosensitive member and lowering of image quality even when the developer is used for a long period of time.

A further object of this invention is to provide a non-magnetic one-component developer free from lowering of its flowability and changing of image quality.

The present inventors have carried out an extensive investigation with a view toward overcoming the above-mentioned problems of the prior art. As a result, it has been found that when a fine inorganic powder having a great particle size and good polishing effect, which has been subjected to the following modification treatment: (i) a treatment with a silicone oil to make it hydrophobic (hereinafter referred to as "hydrophobicity-imparting treatment"); or (ii) a two-step hydrophobicity-imparting treatment with a silane coupling agent or a silazane compound and then further with a silicone oil, is used in a developer, the flowability of the developer can be enhanced and the above-described objects can be attained.

The present invention has been led to completion on the basis of this finding.

According to the present invention, there is thus provided a non-magnetic one-component developer suitable for use in a development system in which a development blade for controlling the layer thickness of the developer is arranged so as to bring it into contact under pressure with the surface of a development roll, the developer is evenly applied to the surface of the development roll and the development roll is brought into direct contact with an electrostatic latent image on a photosensitive member or caused to face in a non-contact relation with the latent image, thereby developing the latent image, comprising 100 parts by weight of colored fine particles, which comprises at least a binder resin and a colorant, and 0.3–10 parts by weight of at least one fine inorganic powder selected from (i) a fine inorganic powder (I) obtained by subjecting a fine inorganic powder having an average particle size of 0.1–10 μm and a heating loss (under drying conditions of 150° C. and 1 hour) of at most 1 wt.% to a hydrophobicity-imparting treatment with a silicone oil and (ii) a fine inorganic powder (II) obtained by subjecting a fine inorganic powder having an average particle size of 0.1–10 μm to a two-step hydrophobicity-imparting treatment with at least one compound selected from silane coupling agents and silazane compounds and then further with a silicone oil.

In the case where the fine inorganic powder is subjected to a hydrophobicity-imparting treatment with at least one of the silane coupling agents and the silazane compounds in advance, the heating loss (under drying conditions of 150° C. and 1 hour) of the fine inorganic powder after the treatment may preferably be controlled to at most 1 wt.%.

The charge level of the fine inorganic powders (I) or (II) imparted with hydrophobicity may preferably be −50 to −150 μC/g as determined in accordance with the blow-off method (this charge level will hereinafter be called the "blow-off charge level") and its degree of hydrophobicity may preferably be 5–50.

The developer according to this invention may be used in copying machines and printers of various systems, but may preferably be used in a recycling system in which an untransferred developer remaining on a photosensitive member is scraped by a cleaning blade or the like to recover it and the thus-recovered developer is then returned to a developing region (for example, a developer container).

As the fine inorganic powder, may be used various kinds of powders. In particular, silicon dioxide, aluminum silicate, magnesium silicate or alumina is preferred.

DETAILED DESCRIPTION OF THE INVENTION

Figure 1:
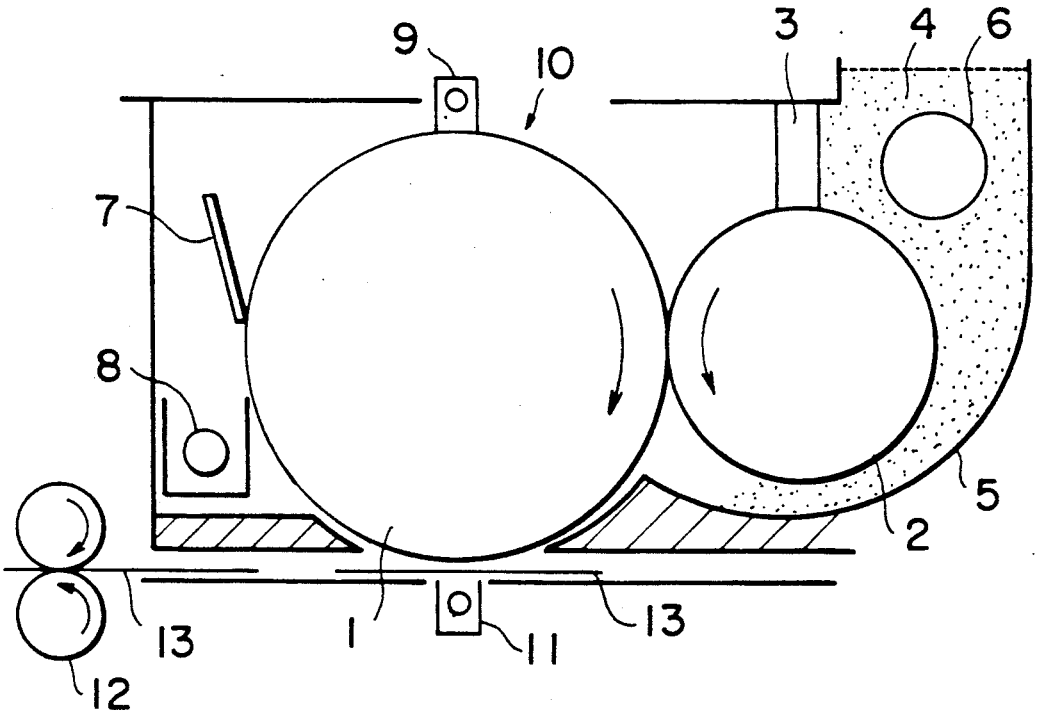
FIG. 1 is a schematic cross-sectional view illustrating one embodiment of developing apparatus and methods to which a non-magnetic one-component developer according to this invention can be applied.

Features of the present invention will hereinafter be described in detail.

(Fine inorganic powder)

The fine inorganic powder useful in the practice of this invention has a particle size in the range of 0.1–10 μm, preferably 0.3–5 μm. If the particle size should be smaller than 0.1 μm, a resulting developer will have little polishing effect. On the other hand, any particle sizes greater than 10 μm will result in a developer by which a photosensitive member and the like are damaged and which has lowered flowability, whereby image quality is deteriorated.

The proportion of the fine inorganic powder (I) and/or (II) imparted with hydrophobicity falls within a range of 0.3–10 parts by weight, preferably 0.5–5.0 parts by weight per 100 parts by weight of the fine colored particles comprising the binder resin and colorant. Any proportions lower than 0.3 part by weight will result in a developer having little polishing effect. On the other hand, any proportions higher than 10 parts by weight will result in a developer having lowered flowability, whereby image quality is deteriorated.

As the material of the fine inorganic powder used in this invention, silicon dioxide, aluminum silicate, magnesium silicate or alumina is preferred from the viewpoint of polishing effect.

Regarding the fine inorganic powder (I) imparted with hydrophobicity, a fine inorganic powder having a heating loss of at most 1 wt.%, preferably at most 0.5 wt.% as determined under drying conditions of 150° C. and 1 hour is used as a raw material. If the heating loss should be greater than 1 wt.%, the subsequent hydrophobicity-imparting treatment cannot be conducted successfully, whereby the flowability of a resulting developer cannot be enhanced. If the heating loss (under drying conditions of 150° C. and 1 hour) of the fine inorganic powder before the hydrophobicity-imparting treatment is high, it is therefore important to control it to at most 1 wt.% by subjecting the powder to a heat treatment or the like in advance.

(Hydrophobicity-imparting treatment)

In this invention, (i) the fine inorganic powder (I) obtained by subjecting a fine inorganic powder to the hydrophobicity-imparting treatment with a silicone oil or (ii) the fine inorganic powder (II) obtained by subjecting a fine inorganic powder to the two-step hydrophobicity-imparting treatment with a silane coupling agent or a silazane compound and then further with a silicone oil is used in order to enhance the flowability of a resulting developer. Both fine inorganic powders thus hydrophobicity-imparted may be used in combination.

Regarding the fine inorganic powder (II) imparted with hydrophobicity, a fine inorganic powder is subjected to the hydrophobicity-imparting treatment with a silane coupling agent or a silazane compound in advance to control its heating loss to preferably at most 1 wt.%, more preferably at most 0.5 wt.% as determined under drying conditions of 150° C. and 1 hour, and then subjected further to the hydrophobicity-imparting treatment with a silicone oil. The silane coupling agent useful in the practice of this invention may include, for example, the following compound:

(1) Vinyl-containing compounds:

$H_2C{=}CHSiCl_3$ $H_2C{=}CHSi(OC_2H_5)_3$ $H_2C{=}CHCH_2SiCl_3$ $H_2C{=}CHCH_2Si(CH_3)Cl_2$ $H_2C{=}CHCH_2Si(CH_3)_2Cl$ $H_2C{=}CHCH_2Si(OC_2H_5)_3$ $H_2C{=}CHSi(OC_2H_4OCH_3)_3$ $(H_2C{=}CHCH_2)_2SiCl_2$ $(H_2C{=}CH)_2Si(OC_2H_5)_2$ $(H_2C{=}CH)_2SiOC_2H_5$

-continued

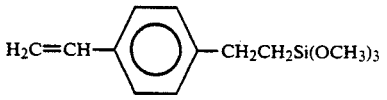

(2) Glycidoxy-containing compounds:

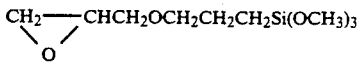

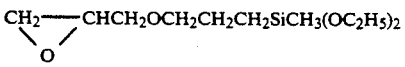

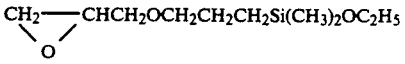

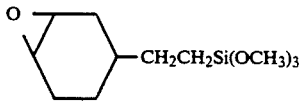

(3) Mercapto-containing compounds:

$HSCH_2CH_2CH_2Si(OCH_3)_3$ $HSCH_2CH_2CH_2Si(OC_2H_5)_3$ (4) Methacrylic-containing compounds:

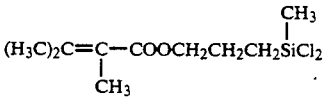

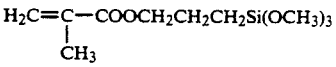

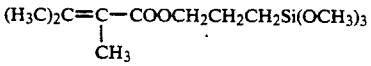

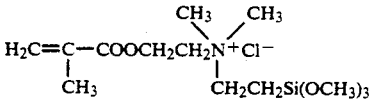

The alkoxy groups of the above-exemplified silane coupling agents may be replaced by chlorine atoms.

The silazane compound useful in the practice of this invention may include, for example, the following compound:

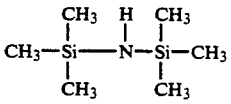

In addition to the above compound, hexamethylcyclotrisilazane, octamethylcyclotetrasilazane and the like may be mentioned.

These silane coupling agents and silazane compounds may be used either singly or in combination.

The silane coupling agent or silazane compound is used as is or by diluting with an organic solvent. In general, the amount of the silane coupling agent or silazane compound to be used is preferably 0.1–10 parts by weight per 100 parts by weight of the fine inorganic powder.

The first-step hydrophobicity-imparting treatment is conducted by first adding the silane coupling agent or silazane compound itself or its dilute solution with an organic solvent to the fine inorganic powder, mixing the resultant mixture by a mixer such as a Henschel mixer and then, after removing the solvent from the mixture by air drying when the solvent is used, hardening the silane coupling agent or silazane compound under heating or by other means.

In the first-step hydrophobicity-imparting treatment making use of the silane coupling agent or silazane compound, a mixed solvent of an organic solvent and water is used as a diluent in some cases in order to control reactivity. For this reason, the treated fine inorganic powder still contains absorbed water unless the drying after treatment is complete. This adversely affects the hardening in the second-step hydrophobicity-imparting treatment with the silicone oil, resulting in a developer having insufficient flowability. Therefore, it is important to control the heating loss of the fine inorganic powder after completion of the first-step hydrophobicity-imparting treatment to preferably at most 1 wt.%, more preferably at most 0.5 wt.% as determined under drying conditions of 150° C. and 1 hour.

The silicone oil is used as is or by diluting with an organic solvent. In general, the amount of the silicone oil to be used is about 0.1–10 parts by weight based on 100 parts by weight of the fine inorganic powder.

The hydrophobicity-imparting treatment is conducted by adding the silicone oil itself or its dilute solution with an organic solvent to the fine inorganic powder or that subjected to the first-step hydrophobicity-imparting treatment with the silane coupling agent or silazane compound, mixing the resultant mixture by a mixer such as a Henschel mixer and then, after removing the solvent from the mixture by air drying when the solvent is used, hardening the silicone oil or making the fine inorganic powder wetted with the silicone oil by either heating the mixture or using a hardening catalyst under temperature conditions of from room temperature to 300° C for several minutes to several days.

As exemplary silicone oils usable in this invention, may be mentioned various kinds of silicone oils such as a dimethyl silicone oil, methylphenyl silicone oil, methyl hydrogen silicone oil, silanol-modified silicone oil, alkyl-modified silicone oil, amino-modified silicone oil, epoxy-modified silicone oil and fluorosilicone oil and silicone-polyether copolymers. Of these, the dimethyl silicone oil, methyl hydrogen silicone oil and silanolmodified silicone oil are particularly preferred in view of easiness of treatment, water-repellent performance, etc.

The dimethyl silicone oil has a viscosity of 10–2,000 cSt and is used as is or by diluting with an organic solvent. The dimethyl silicone oil is added in a proportion of 0.1–10 parts by weight based on 100 parts by weight of the fine inorganic powder and the resultant mixture is mixed by a Henschel mixer or the like. Thereafter, when the organic solvent is used, it is removed from the mixture by air drying. The mixture was heated at 100°–300° C. for 10 minutes to 10 hours to harden the silicone oil or make the fine inorganic powder wetted with the same, thereby imparting hydrophobicity to the fine inorganic powder.

The methyl hydrogen silicone oil is used as is or by diluting with an organic solvent. The methyl hydrogen silicone oil is added in a proportion of 0.1–10 parts by weight based on 100 parts by weight of the fine inorganic powder and the resultant mixture is mixed by a Henschel mixer. Thereafter, when the organic solvent is used, it is removed from the mixture by air drying. The mixture was then heated at 100°–200° C. for 0.5–5 hours to harden the silicone oil or make the fine inorganic powder wetted with the same. Alternatively, a catalyst such as zinc octylate, tin octylate or dibutyltin dilaurate is added in a proportion of 0.1–5 parts by weight based on the 100 parts by weight of the methyl hydrogen silicone oil and, after removing the solvent from the mixture by air drying when the solvent is used, the hydrophobicity-imparting treatment is performed at a temperature from room temperature to 200° C. for 0.5–24 hours.

In the case of the silanol-modified silicone oil, 2–10 parts by weight of the methyl hydrogen silicone oil or alkoxy-modified silicone oil as a crosslinking agent and 0.5–5 parts by weight of zinc octylate, tin octylate or dibutyltin dilaurate as a catalyst are mixed with 100 parts by weight of the silanol-modified silicone oil. The resultant mixture is diluted with an organic solvent. The dilute solution is mixed with the fine inorganic powder in such a manner that the silanol-modified silicone oil is contained in a proportion of 0.5–2 parts by weight per 100 parts by weight of the fine inorganic powder. After the resulting mixture is air-dried, the silanol-modified silicone oil is hardened at a temperature from room temperature to 200° C. for 0.5–24 hours or the fine inorganic powder is wetted with the silicone oil.

The blow-off charge level of the fine inorganic powder (I) or (II) imparted with the hydrophobicity according to this invention preferably falls within the range of −50 to −150 μC./g. Any blow-off charge levels greater than −50 μC./g will be too insufficient not to lower the image density. Any blow-off charge levels smaller than −150 μC./g will often produce fog.

The degree of hydrophobicity (according to the methanol wettability method) of the fine inorganic powder (I) or (II) imparted with the hydrophobicity preferably falls within the range of 5–50. If the degree of hydrophobicity should be less than 5, the flowability of a resulting developer will be lowered, and the deterioration of image density and the production of fog will occur under high humidity. On the other hand, if the degree of hydrophobicity should exceed 50, the polishing effect of the fine inorganic powder will become lowered, and the deterioration of image density and the production of fog and scumming caused by adhesion of a resulting developer to a photosensitive body will occur in a durability test. (Binder resin, colorant and others)

As the binder resin for the developer usable in this invention, may be mentioned various kinds of resins, which have been widely used in developers for electrophotography or printers to date, for example, polymers of styrene and substituted styrenes, such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymer, styrene-octyl acrylate copolymers, styrene-methyl methacrylate copolymers, styrene-ethyl methacrylate copolymers, styrene-butyl methacrylate copolymers, styrene-methyl α-chloro-methacrylate, styrene-acrylonitrile copolymers, styrenevinyl methyl ether copolymers, styrene-vinyl ethyl ether copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic ester copolymers; polymethyl methacrylate; polyvinyl chloride; polyvinyl acetate; polyethylene; polypropylene; polyesters; polyurethanes; polyamides; epoxy resins; polyvinyl butyral; polyacrylic acid resins; rosin; modified rosins; terpene resins; phenol resins; aliphatic or alicyclic hydrocarbon resins; aromatic petroleum resins; chlorinated paraffins; and paraffin wax. These resins may be used either singly or in combination.

As the charge control agents usable in the developer, may be mentioned conventionally known agents such as oxidized starch, metallized dyes, metal complexes of salicylic acid, nigrosine dyes, triphenylmethane dyes, rhodamine dyes and phthalocyanine dyes.

As the colorants usable in the developer, may be mentioned conventionally known colorants such as carbon black, dyes and pigments.

(Recycle and reuse of untransferred developer)

An untransferred developer remaining on a photosensitive member after development by a developing apparatus used in a copying machine or a printer is preferably used in a recycling manner in which the untransferred developer is scraped by a cleaning blade or the like to recover it and the thus-recovered developer is fed back by a screw or the like to an original developer container (a developing region) to reuse it.

(Developing method)

The non-magnetic one-component developer according to this invention is suitable for use in a development system in which a development blade for controlling the layer thickness of the developer is arranged so as to bring it into contact under pressure with the surface of a development roll, the developer is evenly applied to the surface of the development roll and the development roll is brought into direct contact with an electrostatic latent image on a photosensitive member or caused to face in a non-contact relation with the latent image, thereby developing the latent image.

A developing apparatus and method in which the developer according to this invention can be used will hereinafter be described with reference to FIG. 1.

As illustrated in FIG. 1, a developer 4 contained in a developer container 5 is moved between a development roll 2 and a development blade 3 by a stirring rod 6 to forcedly form a thin layer of the developer on the development roll 2 and at the same time, the thin layer of the developer 4 is electrically charged.

A photosensitive member 1 is electrically charged by a charger wire 9 in advance, to which a photo-signal or photo-image 10 is exposed, thereby forming an electrostatic latent image on the photosensitive member 1. The developer on the development roll 2 is brought into contact with the latent image to develop it. The thus-developed image on the photosensitive member 1 is then transferred to a support member 13 such as paper using a charger wire 11 for transfer. The support member 13 is then caused to pass through between heating rolls 12 to fix the image to the support member 13.

At this time, an untransferred developer remaining on the photosensitive member 1 is scraped by a cleaning blade 7 and returned by a screw 8 to the developer container 5, thereby recycling it for reuse.

ADVANTAGE OF THE INVENTION

According to this invention, there is provided a non-magnetic one-component developer, which has sufficient charging characteristic, flowability and environmental stability as a developer suitable for use in a contact or non-contact development system and is high in image quality level such that high image density can be obtained and the production of fog occurs little.

The non-magnetic one-component developer according to the present invention is free from formation of a film caused by adhesion of the developer to a development roll, development blade and/or photosensitive member and from changing of image quality even when it is used in a recycling system, and has a variety of excellent properties.

EMBODIMENTS OF THE INVENTION

The present invention will hereinafter be described specifically by the following examples and comparative examples. However, this invention is not intended to be limited to these examples only.

Incidentally, the evaluation as to physical properties of the developers according to this invention was conducted by the following methods.

<Flowability>

The flowability of each developer was evaluated by measuring it by a powder tester manufactured by Hosokawa Micron Corporation. Namely, a fixed weight of the developer was weighed out to put it on a sieve of 60 mesh. The sieve was shaken at a predetermined amplitude for a fixed period of time. The weight of the toner passed through the sieve is expressed as its flowability in terms of weight per minute.

<Blow-off charge level>

The charge level of a fine inorganic powder imparted with hydrophobicity was measured in the following manner. Namely, 59.7 g of a carrier, "TEFV 150/250" (product of Powdertec K.K.) and 0.3 g of the fine inorganic powder were weighed to place them into an SUS-made pot. After rotating the pot for 30 minutes, the powder was blown off under a nitrogen gas pressure of 1 $kg/cm^2$ in a blow-off meter manufactured by Toshiba Chemical Corporation.

<Degree of Hydrophobicity>

A stirrer rod of a stirrer was placed in a 100-ml beaker, in which 50 ml of distilled water was poured. A fine inorganic powder to be determined was weighed by 0.2 g and softly floated on the surface of the water. The beaker was placed on the stirrer and the stirrer rod was moved to stir the water gently.

A burette was charged with methanol and placed in the beaker in such a manner that the tip of the burette lies under the surface of the water, followed by dropwise addition of methanol. The amount of methanol added dropwise was read out at the time the fine inorganic powder on the surface of the water began to sink to calculate the volume percentage of methanol in the beaker. This value was taken as the degree of hydrophobicity.

<Image properties>

As a durability test, copying was conducted 20,000 times with each developer sample by the developing apparatus illustrated in FIG. 1 to visually observe the image density and production of fog as to each copy, the formation of a film caused by adhesion of the developer onto a photosensitive member, etc., thereby evaluating its image properties.

The evaluation of the image density (ID) was performed by measuring a black solid area by a "Macbeth" reflection densitometer.

Incidentally, the developer was used in a recycling manner.

As an environmental test, copying was conducted under circumstances of high temperature and high humidity, i.e., 30° C. and 80% RH, and a low temperature and low humidity, i.e., 10° C. and 20% RH to evaluate an image copied in the same way as described above.

The image properties in each test were evaluated in accordance with the following 3 ranks:

O: Image is stable and good;

Δ: Image density is somewhat low or production of fog is slightly observed; and

X: Image density is low, production of fog is observed, uneven portions occurs on the image or a film of the developer adheres to the photosensitive member.

EXAMPLE 1

After mixing 100 parts by weight of a styrene-butyl acrylate copolymer as a binder resin, 8 parts by weight of carbon black as a colorant, 4 parts by weight of a lower-molecular weight polypropylene and 2 parts by weight of a metallized dye by a Henschel mixer, the resultant mixture was intimately kneaded by kneading rolls of 150° C. After the mixture thus kneaded was then cooled and ground by a granulator, the resultant coarse particles were ground by an air-jet grinder to 5–20 μm and particles having a particle size of 12 μm were collected by a classifier, thereby preparing colored fine particles.

A fine inorganic powder imparted with hydrophobicity was prepared by adding 1 part by weight of a dimethyl silicone oil to 100 parts by weight of silicon dioxide, mixing the resultant mixture by a Henschel mixer and then heating the mixture at 250° C. for 2 hours to harden the silicone oil or make the silicon dioxide wetted with the silicone oil.

Two parts by weight of the fine inorganic powder thus imparted with the hydrophobicity were added to 100 parts by weight of the colored fine particles. The resultant mixture was blended by a Henschel mixer to obtain a non-magnetic one-component developer.

The particle size of the silicon dioxide used was 2.5 μm and its heating loss (150° C. and 1 hour) was 0.3 wt.%.

The flowability of the developer thus obtained was as high as 65 and was hence sufficient. As a durability test, copying was conducted 20,000 times by the developing apparatus illustrated in FIG. 1. The images of the copies were stable from the beginning and their quality was not changed even when the copying had been conducted twenty thousand times.

Furthermore, the image density was changed only a little and was good even under both conditions of humidity as low as 20% RH at 10° C. and humidity as high as 80% RH at 30° C.

COMPARATIVE EXAMPLE 1

The same silicon dioxide as that used in Example 1 was left to stand under high humidity and then its heating loss (150° C., 1 hour) was determined. As a result, it was found to be 1.6 wt.%. A non-magnetic one-component developer was obtained in the same manner as in Example 1 except that this fine inorganic powder was used.

The flowability of the developer thus obtained was as low as 25 and was hence insufficient. Further, the durability test was conducted. As a result, it was found that the image density was low from the beginning and the production of fog was also observed. The copying of twenty thousand sheets revealed that uneven portions appeared on the images, and hence the developer was unfit for service.

EXAMPLES 2–3

Developers were separately obtained in substantially the same manner as in Example 1 except that other kinds of silicone oils were used in place of the silicone oil used in Example 1 as shown in Table 1 to conduct the hydrophobicity-imparting treatment of the fine inorganic powder, and they were evaluated similarly.

A methyl hydrogen silicone oil and a mixture of 5 parts by weight of the same methyl hydrogen silicone oil, 100 parts by weight of a silanol-modified silicone oil and 1.0 part by weight of dibutyltin dilaurate were used in Example 2 and Example 3, respectively.

As a result of the evaluation, it was found that both developers had high flowability and images obtained therefrom were stable and good in quality as with Example 1.

The results are shown in Table 1.

COMPARATIVE EXAMPLE 2

A non-magnetic one-component developer was obtained in the same manner as in Example 1 except that silicon dioxide having a particle size as small as 0.016 μm was used as a fine inorganic powder.

The flowability of the developer thus obtained was as high as 75 and was hence sufficient. In the durability test, the developer involved no problem in the beginning. However, black stripes appeared on copies as the number of copies increased. The inspection of the surface of the photosensitive body revealed that a film caused by the adhesion of the developer was formed thereon.

The results are shown in Table 1.

COMPARATIVE EXAMPLE 3

A non-magnetic one-component developer was obtained in the same manner as in Example 1 except that silicon dioxide having a particle size as great as 15 μm was used as a fine inorganic powder.

The flowability of the developer thus obtained was as low as 20 and was hence insufficient. The durability test revealed that the image density was low from the beginning and the production of fog was also observed. As a result of the copying of twenty thousand sheets, uneven portions were recognized on the images. The developer was hence unfit for service.

The results are shown in Table 1.

EXAMPLES 4–5

Developers were separately obtained in the same manner as in Example 1 except that aluminum silicate and magnesium silicate were used, as fine inorganic powders, in Example 4 and Example 5, respectively, as shown in Table 1, and a methyl hydrogen silicone oil was used as a silicone oil, and they were evaluated similarly.

As a result, it was found that both developers thus obtained had high flowability an images obtained therefrom were stable and good in quality. By the way, the production of fog was somewhat observed in Example 4, but the developer was still practicable without problems.

The results are shown in Table 1.

COMPARATIVE EXAMPLE 4

A developer was obtained in the same manner as in Example 1 except that the fine inorganic powder which had been obtained in Example 1 and imparted with the hydrophobicity was used in an amount of 0.1 part by weight, and it was evaluated similarly. As a result, it was found that the developer thus obtained was low in image density, the production of fog was observed and black stripes appeared on copies as the number of copies increased. Closer inspection revealed that a film of the developer was formed on the surface of the photosensitive member.

The results are shown in Table 1.

COMPARATIVE EXAMPLE 5

A developer was obtained in the same manner as in Example 1 except that the fine inorganic powder which had been obtained in Example 1 and imparted with the hydrophobicity was used in an amount of 15 parts by weight, and it was evaluated similarly. As a result, it was found that the flowability of the developer thus obtained was low and the image density was also low. Fog and uneven areas on image appeared as the number of copies increased. The developer was hence unfit for service.

The results are shown in Table 1.

COMPARATIVE EXAMPLE 6

A developer was obtained in the same manner as in Example 1 except that the fine inorganic powder used in Example 1 was used as is without subjecting it to the hydrophobicity-imparting treatment, and it was evaluate similarly.

The flowability of the developer thus obtained was as low as 23. The durability test revealed that the image density was low from the beginning and also the production of fog was often observed. Fog and uneven areas on image became heavier as the number of copies increased. The developer was hence unfit for service.

Moreover, under high temperature and humidity conditions, the image density became lower and fog also became still heavier from the beginning of the copying.

The results are shown in Table 1.

TABLE 1

| | Ex. 1 | Ex. 2 | Ex. 3 | Ex. 4 | Ex. 5 | Comp. Ex. 1 | Comp. Ex. 2 | Comp. Ex. 3 | Comp. Ex. 4 | Comp. Ex. 5 | Comp. Ex. 6 |
|---|---|---|---|---|---|---|---|---|---|---|---|
| Fine inorganic powder: | | | | | | | | | | | |
| Kind | Silicon dioxide | Silicon dioxide | Silicon dioxide | Aluminum silicate | Magnesium silicate | Silicon dioxide | Silicon dioxide | Silicon dioxide | Silicon dioxide | Silicon dioxide | Silicon dioxide |
| Particle size (μm) | 2.5 | 2.5 | 2.5 | 1.4 | 3.6 | 2.5 | 0.016 | 15 | 2.5 | 2.5 | 2.5 |
| Heating loss (%) | 0.3 | 0.3 | 0.3 | 0.5 | 0.6 | 1.6 | 0.4 | 0.3 | 0.3 | 0.3 | 0.3 |
| Silicone oil: | | | | | | | | | | | |
| Kind | Dimethyl silicone oil | Methyl hydrogen silicone oil | Methyl hydrogen silicone oil 5 p., silanol-modified silicone oil 100 p. | Methyl hydrogen silicone oil | Methyl hydrogen silicone oil | Dimethyl silicone oil | Dimethyl silicone oil | Dimethyl silicone oil | Dimethyl silicone oil | Dimethyl silicone oil | — |
| Amount used (wt. p.) | 1.0 | 1.0 | 1.0 | 1.0 | 1.0 | 1.0 | 1.0 | 1.0 | 1.0 | 1.0 | — |
| After hydrophobicity-imparting treatment: | | | | | | | | | | | |
| Degree of hydrophobicity | 35 | 35 | 30 | 35 | 40 | 25 | 50 | 60 | 35 | 35 | 0 |
| Blow-off charge level (μC/g) | −105 | −125 | −135 | −130 | −100 | −85 | −180 | −30 | −105 | −105 | −60 |
| Amount of treated fine inorganic powder used (wt. parts) | 2 | 2 | 2 | 2 | 2 | 2 | 0.5 | 2 | 0.1 | 15 | 2 |
| Flowability (g/min) | 65 | 60 | 65 | 65 | 55 | 25 | 75 | 20 | 70 | 70 | 23 |
| Image properties: | | | | | | | | | | | |
| Image density | ○ | ○ | ○ | ○ | ○ | X | ○ | X | ○ | X | X |
| Fog | ○ | ○ | ○ | Δ | ○ | X | X | X | ○ | X | X |
| Durability | ○ | ○ | ○ | ○ | ○ | X | X | X | X | X | X |
| Environmental stability | ○ | ○ | ○ | ○ | ○ | X | ○ | X | X | X | X |

EXAMPLE 6

Colored fine particles were prepared in the same manner as in Example 1.

To 100 parts by weight of aluminum silicate as a fine inorganic powder, was added 1 part by weight of hexamethyldisilazane. The resultant mixture was blended by a Henschel mixer. After heating the mixture at 150° C. for 1 hour, 1 part by weight of a methyl hydrogen silicone oil was added and the resultant mixture was blended by the Henschel mixer. Thereafter, the mixture was heated further at 150° C. for 1 hour to harden the silicone oil or make the fine inorganic powder wetted with the same, thereby imparting hydrophobicity to the fine inorganic powder.

Two parts by weight of the fine inorganic powder thus imparted with the hydrophobicity were added to 100 parts by weight of the colored fine particles. The resultant mixture was blended by a Henschel mixer to obtain a non-magnetic one-component developer.

The particle size of the aluminum silicate used was 1.4 μm. The flowability of the developer thus obtained was as high as 65 and was hence sufficient.

As a durability test, copying was conducted 20,000 times by the developing apparatus illustrated in FIG. 1 to evaluate the images of copies. It was found that the image density was high from the beginning, no production of fog was observed and the images of the copies were stable in quality to the twenty thousandth copy.

In addition, the developer was evaluated under both conditions of high temperature and humidity and low temperature and humidity. In each test, good results were obtained as with the durability test.

The results are shown in Table 2.

EXAMPLES 7-9

Developer were separately obtained in the same manner as in Example 6 except that various kinds of silane coupling agents were used in place of hexamethyldisilazane used in Example 6 to conduct the hydrophobicity-imparting treatment, and they were evaluated similarly.

One part by weight of 7-chloropropyltrimethoxysilane, 0.5 part by weight of vinyltriethoxysilane and 0.5 part by weight of 7-mercaptopropyltrimethoxysilane were used in Example 7, Example 8 and Example 9, respectively. Incidentally, aluminum silicate having a particle size of 0.8 μm was used instead of that in Example 6.

The results are shown in Table 2.

The evaluation revealed that all the developers had high flowability and images obtained therefrom were stable and good in quality.

EXAMPLES 10-11

Developer were separately obtained in the same manner as in Example 6 except that other kinds of silicone oils were used in place of the silicone oil used in Example 6 to conduct the hydrophobicity-imparting treatment, and they were evaluated similarly.

A dimethyl silicone oil and a mixture of 5 parts by weight of a methyl hydrogen silicone oil, 100 parts by weight of a silanol-modified silicone oil and 1.0 part by weight of dibutyltin dilaurate were used in Example 10 and Example 11, respectively.

As with Example 6, both developers had high flowability and images obtained therefrom were stable and good in quality.

The results are shown in Table 2.

EXAMPLES 12-13

As shown in Table 2, silicon dioxide and magnesium silicate were used, as fine inorganic powders, in Example 12 and Example 13, respectively. Beside, in both examples, each 1.0 part by weight of hexamethyldisilazane, and 0.5 part by weight (Example 12) or 1.0 part by weight (Example 13) of a methyl hydrogen silicone oil as a silicone oil were used.

As with Example 6, both developers had high flowability and images obtained therefrom were stable and good in quality.

The results are shown in Table 2.

TABLE 2

| | Ex. 6 | Ex. 7 | Ex. 8 | Ex. 9 | Ex. 10 | Ex. 11 | Ex. 12 | Ex. 13 |
|---|---|---|---|---|---|---|---|---|
| Fine inorganic powder: | | | | | | | | |
| Kind | Aluminum silicate | Aluminum silicate | Aluminum silicate | Aluminum silicate | Aluminum silicate | Aluminum silicate | Silicon dioxide | Magnesium silicate |
| Particle size (m) | 1.4 | 1.4 | 0.8 | 1.4 | 1.4 | 1.4 | 2.5 | 3.6 |
| Silane coupling agent, etc.: | | | | | | | | |
| Kind | Hexamethyldisilazane | γ-Chloropropyltrimethoxysilane | Vinyltriethoxysilane | γ-Mercaptopropyltrimethoxysilane | Hexamethyldisilazane | Hexamethyldisilazane | Hexamethyldisilazane | Hexamethyldisilazane |
| Amount used (wt. parts) | 1.0 | 1.0 | 0.5 | 0.5 | 1.0 | 1.0 | 1.0 | 1.0 |
| Heating loss after treatment with silane coupling agent or the like (%) | 0.4 | 0.3 | 0.5 | 0.4 | 0.3 | 0.4 | 0.3 | 0.3 |
| Silicone oil: | | | | | | | | |
| Kind | Methyl hydrogen silicone oil | Methyl hydrogen silicone oil | Methyl hydrogen silicone oil | Methyl hydrogen silicone oil | Dimethyl silicone oil | Methyl hydrogen silicone oil 5 p., silanol-modified silicone oil 100 p. | Methyl hydrogen silicone oil | Methyl hydrogen silicone oil |
| Amount used (wt. parts) | 1.0 | 1.0 | 1.0 | 1.0 | 1.0 | 1.0 | 0.5 | 1.0 |
| After hydrophobicity-imparting treatment: | | | | | | | | |
| Degree of hydrophobicity | 35 | 45 | 30 | 35 | 40 | 30 | 30 | 35 |
| Blow-off charge level (μC/g) | −125 | −145 | −135 | −80 | −100 | −135 | −125 | −85 |
| Amount of treated fine inorganic powder used (wt. parts) | 2 | 2 | 1 | 2 | 2 | 2 | 2 | 3 |
| Flowability (g/min) | 65 | 60 | 75 | 60 | 60 | 65 | 50 | 45 |

TABLE 2-continued

| | Ex. 6 | Ex. 7 | Ex. 8 | Ex. 9 | Ex. 10 | Ex. 11 | Ex. 12 | Ex. 13 |
|---|---|---|---|---|---|---|---|---|
| Image properties: | | | | | | | | |
| Image density | ○ | ○ | ○ | ○ | ○ | ○ | ○ | ○ |
| Fog | ○ | ○ | ○ | ○ | ○ | ○ | ○ | ○ |
| Durability | ○ | ○ | ○ | ○ | ○ | ○ | ○ | ○ |
| Environmental stability | ○ | ○ | ○ | ○ | ○ | ○ | ○ | ○ |

COMPARATIVE EXAMPLE 7

The hydrophobicity-imparting treatment was performed in the same manner as in Example 6 except that the treatment was conducted with the hexamethyldisilazane alone.

The developer thus obtained was low in flowability. The durability test revealed that the initial image density was low and also the production of fog was often observed, and hence the developer had image properties unfit for service.

The results are shown in Table 3.

COMPARATIVE EXAMPLE 8

Silicon dioxide having a particle size of b 0.016 μm was used as a fine inorganic powder. The inorganic powder was subjected to the two-step hydrophobicity-imparting treatment with hexamethyldisilazane and a methyl hydrogen silicone oil. The thus-treated powder was mixed with the same colored fine particles as those used in Example 6, thereby obtaining a developer.

As shown in Table 3, the initial image density was good. However, the image density became lowered, the production of fog increased, and black stripes also appeared on copies as the number of copies increased. The inspection of the photosensitive member revealed that the developer adhered thereon to form a film of the developer.

The results are shown in Table 3.

COMPARATIVE EXAMPLE 9

A developer was obtained in the same manner as in Example 6 except that silicon dioxide having a particle size as great as 15 μm was used as a fine inorganic powder.

The developer thus obtained was low in flowability and its image quality was such that the image density was low, fog was often produced and hence it was unfit for service.

The results are shown in Table 3.

COMPARATIVE EXAMPLE 10

A developer was obtained in the same manner as in Example 6 except that the amount of the fine inorganic powder used in Example 6 and imparted with hydrophobicity was changed from 2 parts by weight to 0.1 part by weight.

The developer thus obtained had high flowability. However, in the durability test, the initial image properties was good, but black stripes appeared on copies as the number of copies increased. Closer inspection revealed that the developer adhered on the surface of the photosensitive member to form a film of the developer.

The results are shown in Table 3.

COMPARATIVE EXAMPLE 11

A developer was obtained in the same manner as in Example 6 except that the amount of the fine inorganic powder used in Example 6 and imparted with hydrophobicity was changed from 2 parts by weight to 15 parts by weight.

The developer thus obtained had low flowability. The durability test revealed that the initial image density was low, fog was often produced and the developer hence had image properties unfit for service.

The results are shown in Table 3.

COMPARATIVE EXAMPLE 12

A developer was obtained in the same manner as in Example 6 except that a fine inorganic powder, which was same as that used in Example 6, but not treated and had a degree of hydrophobicity of 0, was used.

The developer thus obtained was such that the initial image density was somewhat low, and the image density became lower and the production of fog also increased as the number of copies increased.

The results are shown in Table 3.

COMPARATIVE EXAMPLE 13

The charge level of colloidal silica widely used as a flowability-imparting agent in general was measured. As a result, it showed a very small value as −560 μC/g. With 100 parts by weight of the same colored fine particles as those used in Example 1, was mixed 0.5 part by weight of this colloidal silica to obtain a developer. The thus-obtained developer was evaluated similarly. Its image density was too high from the beginning and fog was often produced. The fog became heavier and the number of black stripes on copies also increased as the number of copies increased. The inspection of the surface of the photosensitive member revealed that the developer adhered thereon to form a film of the developer.

The results are shown in Table 3.

TABLE 3

| | Comp. Ex. 7 | Comp. Ex. 8 | Comp. Ex. 9 | Comp. Ex. 10 | Comp. Ex. 11 | Comp. Ex. 12 | Comp. Ex. 13 |
|---|---|---|---|---|---|---|---|
| Fine inorganic powder: | | | | | | | |
| Kind | Aluminum silicate | Silicon dioxide | Silicon dioxide | Aluminum silicate | Aluminum silicate | Aluminum silicate | Silicon dioxide |
| Particle size (μm) | 1.4 | 0.016 | 15 | 1.4 | 1.4 | 1.4 | 0.016 |
| Silane coupling agent, etc.: | | | | | | | |
| Kind | Hexa-methyl-disilazane | Hexa-methyl-disilazane | Hexa-methyl-disilazane | Hexa-methyl-disilazane | Hexa-methyl-disilazane | — | Dimethyl-dichloro-silane |
| Amount used (wt. parts) | 1.0 | 1.0 | 1.0 | 1.0 | 1.0 | — | 1.0 |
| Heating loss after treatment | 0.5 | 0.3 | 0.8 | 0.4 | 0.4 | 1.2 | 0.5 |

TABLE 3-continued

| | Comp. Ex. 7 | Comp. Ex. 8 | Comp. Ex. 9 | Comp. Ex. 10 | Comp. Ex. 11 | Comp. Ex. 12 | Comp. Ex. 13 |
|---|---|---|---|---|---|---|---|
| with silane coupling agent or the like (%) | | | | | | | |
| Silicone oil: | | | | | | | |
| Kind | — | Methyl hydrogen silicone oil | Methyl hydrogen silicone oil | Methyl hydrogen silicone oil | Methyl hydrogen silicone oil | — | — |
| Amount used (wt. parts) | — | 1.0 | 1.0 | 1.0 | 1.0 | — | — |
| After hydrophobicity-imparting treatment: | | | | | | | |
| Degree of hydrophobicity | 15 | 50 | 80 | 35 | 35 | 0 | 45 |
| Blow-off charge level (μC/g) | −135 | −170 | −40 | −125 | −125 | −80 | −560 |
| Amount of treated fine inorganic powder used (wt. parts) | 2 | 0.5 | 2 | 0.1 | 15 | 2 | 0.5 |
| Flowability (g/min) | 40 | 65 | 20 | 75 | 40 | 30 | 75 |
| Image properties: | | | | | | | |
| Image density | ○ | ○ | X | ○ | ○ | Δ | X |
| Fog | ○ | ○ | X | ○ | X | X | X |
| Durability | X | X | X | X | ○ | X | X |
| Environmental stability | X | ○ | ○ | ○ | ○ | X | ○ |

We claim:

1. A non-magnetic one-component developer suitable for use in a development system in which a development blade for controlling the layer thickness of the developer is arranged so as to bring it into contact under pressure with the surface of a development roll, the developer is evenly applied to the surface of the development roll and the development roll is brought into direct contact with an electrostatic latent image on a photosensitive member or caused to face in a non-contact relation with the latent image, thereby developing the latent image, comprising:

100 parts by weight of colored fine particles, which comprise at least a binder resin and a colorant; and 0.3–10 parts by weight of at least one fine inorganic powder selected form (i) a fine inorganic powder (I) obtained by subjecting a fine inorganic powder having an average particle size of 0.3–10μm and a heating loss under drying conditions of 150° C. an 1 hour of at most 1 wt.% to a hydrophobicity-imparting treatment with a silicone oil, and (ii) a fine inorganic powder (II) obtained by subjecting a fine inorganic powder having an average particle size of 0.3–10 μm to a two-step hydrophobicity-imparting treatment with at least one compound selected from silane coupling agents and silazane compounds and then further with a silicone oil, wherein the heating loss under drying conditions of 150° C. and 1 hour of the fine inorganic powder after subjected to the hydrophobicity-imparting treatment with at least one compound selected form the silane coupling agents and silazane compounds is at most 1 wt.%, wherein the blow-off charge level of the fine inorganic powder (I) or (II) after subjected to the hydrophobicity-imparting treatment is −50 to −150 μC/g, and wherein the degree of hydrophobicity of the fine inorganic powder (I) or (II) after subjected to the hydrophobicity-imparting treatment is 5–50.

2. The non-magnetic one-component developer as claimed in claim 1, wherein the fine inorganic powder is at least one selected from silicon dioxide aluminum silicate, magnesium silicate and alumina.

3. The non-magnetic one-component developer as claimed in claim 1, which is suitable for use in a recycling system wherein an untransferred developer remaining on a photosensitive member after development is recovered to return same to a developing region.

* * * * *